United States Patent [19]

Liszewski et al.

[11] Patent Number: 4,774,908

[45] Date of Patent: Oct. 4, 1988

[54] DRY ASH HANDLING SYSTEM

[75] Inventors: Cazmier L. Liszewski, Smithton, Pa.; Dale McKeand, Panama City, Fla.

[73] Assignee: Westinghouse Electric Corp., Pittsburgh, Pa.

[21] Appl. No.: 55,400

[22] Filed: May 29, 1987

[51] Int. Cl.[4] ..... F23J 1/00

[52] U.S. Cl. ..... 110/165 R; 110/259; 126/242

[58] Field of Search ..... 110/165 R, 177, 259; 126/242

[56] References Cited

U.S. PATENT DOCUMENTS

| | | | |
|---|---|---|---|
| 3,302,598 | 2/1967 | Godel | 110/165 R |
| 3,537,410 | 11/1970 | Zanft | 110/165 R |
| 3,822,651 | 7/1974 | Harris et al. . | |
| 3,861,333 | 1/1975 | Krumm | 110/165 R X |
| 4,066,024 | 1/1978 | O'Connor . | |
| 4,109,590 | 8/1978 | Mansfield | 110/165 R X |
| 4,226,584 | 10/1980 | Ishikawa . | |

*Primary Examiner*—Edward G. Favors

[57] ABSTRACT

The present invention is a dry ash handling system which creates a vertical ash pile in an ash hopper that allows continued combustion of unburned embers. The ash height allows embers to be completely burned before leaving the bottom of the hopper. The hopper includes an air layer injection system which forces air up through the hot ash from below the top of the ash pile, increasing burn-out efficiency. The air rising through the hot ash returns residual heat to the combustion process increasing combustion efficiency, while cooling the ash to a safe handling temperature. The air capturing the residual heat is replaced with cool fresh air, enhancing cooling and preventing dust from escaping. The sides of the hopper are sloped causing the ash to be mixed as it travels to the bottom, preventing air channels from forming.

13 Claims, 2 Drawing Sheets

DRY ASH HANDLING SYSTEMBACKGROUND OF THE INVENTION

1. Field of the Invention

The present invention is directed to a dry ash discharge system for a solid waste incinerator that cools ash to room temperature for easy handling, and more particularly, to a system that completes combustion of residual materials and returns heat in the ash to the combustion process for improved efficiency.

2. Description of the Related Art

Municipal solid waste incineration systems, such as illustrated in FIG. 1, burn solid waste dumped in chute 10 in a rotary combustor 12 such as an combustor 12 described in detail in U.S. Pat. Nos. 3,822,651 and 4,066,024. Part of the burned waste leaves the O'Connor combustor as fly ash which travels up a burn completion stack 14 and is collected in a fly ash collection system. Bottom ash, including partially burned embers, fall out of the combustor 12 into an ash burning and collection hopper 16 which includes a water cooled stairway grate 18 that allows large ember more time to complete combustion as they roll down the stairway 18. The stairway 18 includes air injection ports which force air against the large embers and to attempt complete combustion by holding the larger pieces in the chamber 14 for an additional time. The ashes then fall into a quenching tank 20 which includes a drag conveyor 22 which carries the wet ash to an ash cart 24. The steam from the tank 20 reduces the efficiency of the system because it must be heated in chamber 14. Ash handling systems that include a drag conveyor 22 are frequently taken out of service because large objects get caught in conveyor scrappers causing the conveyor 22 to grind to a halt if repair is required. The waste disposal system, in such a situation, will be out of service for at least 8 hours, the time required to cool down and then reheat the combustor 12, plus any repair time. The full cart 24 is then carried to a dump and emptied. This type of wet ash system at best, incinerates 95% to 96% of the burnable waste and produces ash which is heavily laden with water. Since waste disposal companies such as municipal waste trucking companies charge by the pound for transportation, the wet ash is much more expensive to discard than dry ash.

Dry ash handling systems have been produced that replace the water tank 20 and stairway 18 with a slowly moving conveyor at the bottom edge of combustor 12. The conveyor is located approximately 4 feet from the bottom edge of the combustor 12 and moves at a rate which allows approximately one foot of dry ash to be deposited on the conveyor. The conveyor is a grate type conveyor that allows air to be injected into the ash in an attempt to complete combustion of large embers. However, because the ash layer on the conveyor is thin and because no mixing of the ash occurs, air channels develop in the ash which prevents combustion efficiency from being improved over the stairway combustion extension device.

SUMMARY OF THE INVENTION

It is an object of the present invention to produce relatively dry ash having a non-zero moisture content so that ash disposal costs can be dramatically reduced.

It is another object of the present invention to increase combustion to ensure that substantially all of the burnable waste is consumed.

It is a further object of the present invention to provide an ash handling system that increases the efficiency of the combustion process allowing reduced fuel costs and increased steam output that can be used for electricity generation.

It is also an object of the present invention to provide a system that can be easily retrofitted to existing wet ash type systems.

The above objects can be attained by a dry ash handling system which creates a vertical ash pile in an ash hopper. The vertical pile allows the continued combustion of unburned embers. The hopper includes an air injection system which forces air into the hot ash, increasing the burn-out efficiency. Part of the air forced into the ash rises through the hot ash pile, returning residual heat to the combustion process improving combustion efficiency while cooling the ash to a safe handling temperature. The air that passes into the combustion process is replaced by fresh air at the bottom of the pile, enhancing cooling and controlling dust.

These objects together with other objects and advantages which will be subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
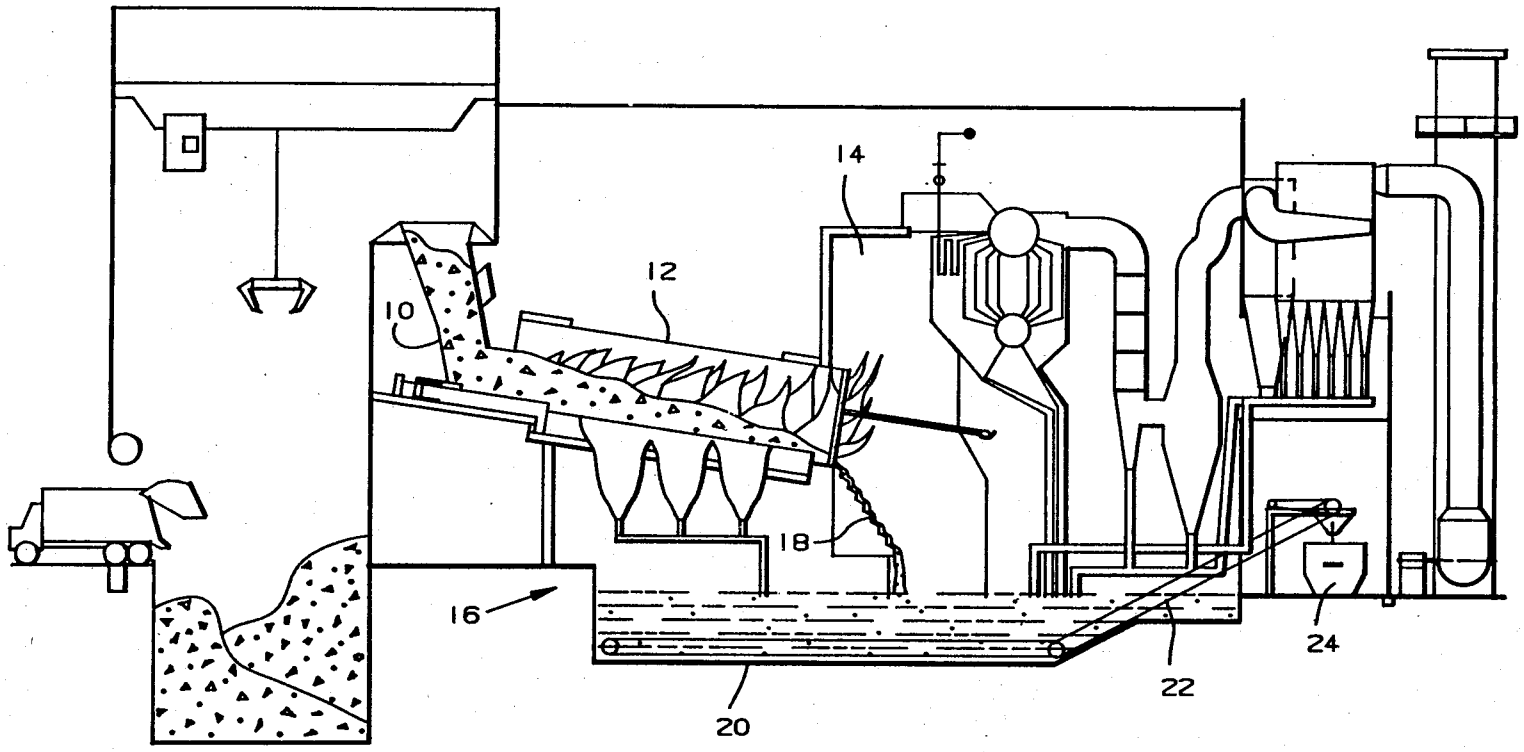
FIG. 1. PRIOR ART
FIG. 1 illustrates a municipal waste incineration system including a prior art wet ash handling system.

The present invention eliminates the faults of prior ash handling systems by allowing the ash a sufficient time to complete combustion and by cooling the ash to an ambient temperature without water cooling. The combustion approaches 99.5% and the energy captured by the cooling process is returned to the combustion process producing a gain in overall efficiency of 6%.

The description herein applies to a hopper 30 designed for an O'Connor combustor model RC-100 that includes an inner diameter of 100 meters and a total combustion air flow of 15480 scfm. Hoppers for other size combustors would be sized substantially linearly based on the inner diameter of the combustor.

Ash residue including embers that continue to burn leave the rotary combustor 12 and fall onto the top 32 of an ash pile in an ash hopper 30. The top 32 of the ash pile is at a temperature of approximately 1400° F. and should be kept about 3 feet below the ring header of the combustor 12. The ash travels down hopper 30 and exits at a temperature of approximately 150° F.

The hopper 30 includes an air injection system 34 which injects air into the ash pile at spaced intervals around the exterior of the hopper 30. A conveyor system 36 at the bottom of the hopper 30 conveys the ash through a water spray chamber 38 where it is misted with water or steam after it reaches the temperature of 150° F. 7% of the total combustion air or 1.15 times the ash flow rate and preferably 10% is injected by the air injection system 34 and travels upward through the ash pile due to the negative 0.5 inch pressure maintained in the chamber 14. A minimum amount of air of 1.0 times the ash flow rate is required. Approximately 4% of the total combustion air injected by the air injection system 34 travels down through the ash pile, is preheated and recirculated through the injection system 34. The air that is carried up into the combustion area is replaced by external air, creating a negative pressure in the bottom of the hopper 30, preventing dust from escaping. The upper section 40 of the hopper 30 is approximately 4 feet tall, 7 feet wide and 13 feet long. This section includes an inner wall section 42 made from a cast refractory material such as Hardcastes manufactured by Harbison-Walker and a water cooled exterior wall section 44 constructed of closely packed water carrying pipes.

The next section of the hopper wall 46 has an inner surface 48 of the refractory material and an outer surface 50 of a flue insulating material also available from Harbison-Walker. An acceptable insulator would be another layer of the Hardcastes refractory lining. At the bottom of the second section air injection ports 66 are spaced at intervals around the exterior of the hopper 30. The injection ports 66 are located approximately 4 feet below the water wall section 40 and are angled sharply downward at an angle of approximately 60°. The downward angle prevents ash from clogging up the injection ports 66.

The third section 52 of the hopper 30 is approximately 3 feet tall, 6 feet wide at the bottom and 13 long. The 6 foot width allows large objects, such as refrigerators to pass through the hopper 30 without getting stuck. The ash temperature, when it reaches the top of section 52 adjacent the injection ports 66 is at a temperature of approximately 600° F. The fourth section 54 has an opening in the direction of movement of the conveyor 66, allowing ash to fall out of the chute in the direction of conveyor movement at an angle of repose of approximately 45°.

The wall of the hopper 30 on the side of the combustor 12 is angled at an angle A of approximately 20°, while the wall opposite the combustor 12 is angled at angle of B of approximately 5°. This creates a sloping hopper 30 that causes light ash to travel horizontally as it falls to the bottom. Heavy objects, which leave the combustor 12, such as nuts, bolts and automobile parts, travel substantially vertically within the hopper 30 while the lighter ash travels both vertically and horizontally. This difference in movement of heavy objects versus light objects mixes the ash, preventing air channels from being formed.

The air injection system 34 includes a shroud 56 which completely surrounds the bottom of the hopper 30 and prevents the escape of ash. The air pumped from the shroud 56 passes through a pipe 58 having an inner diameter of approximately 8 inches into a centrifugal air impeller or pump 60 powered by a variable speed motor of at least five horsepower. The impeller should have a 24 inch diameter. The air leaves the centrifugal pump 60 via a manifold pipe 62 also having an inner diameter of 8 inches. Manifold feeder pipes 64 feed the air injection ports 66. The air injection ports 66 are slits 1 inch high and 6 inches wide and are placed approximately two feet apart around the exterior of the hopper 30.

Figure 2:
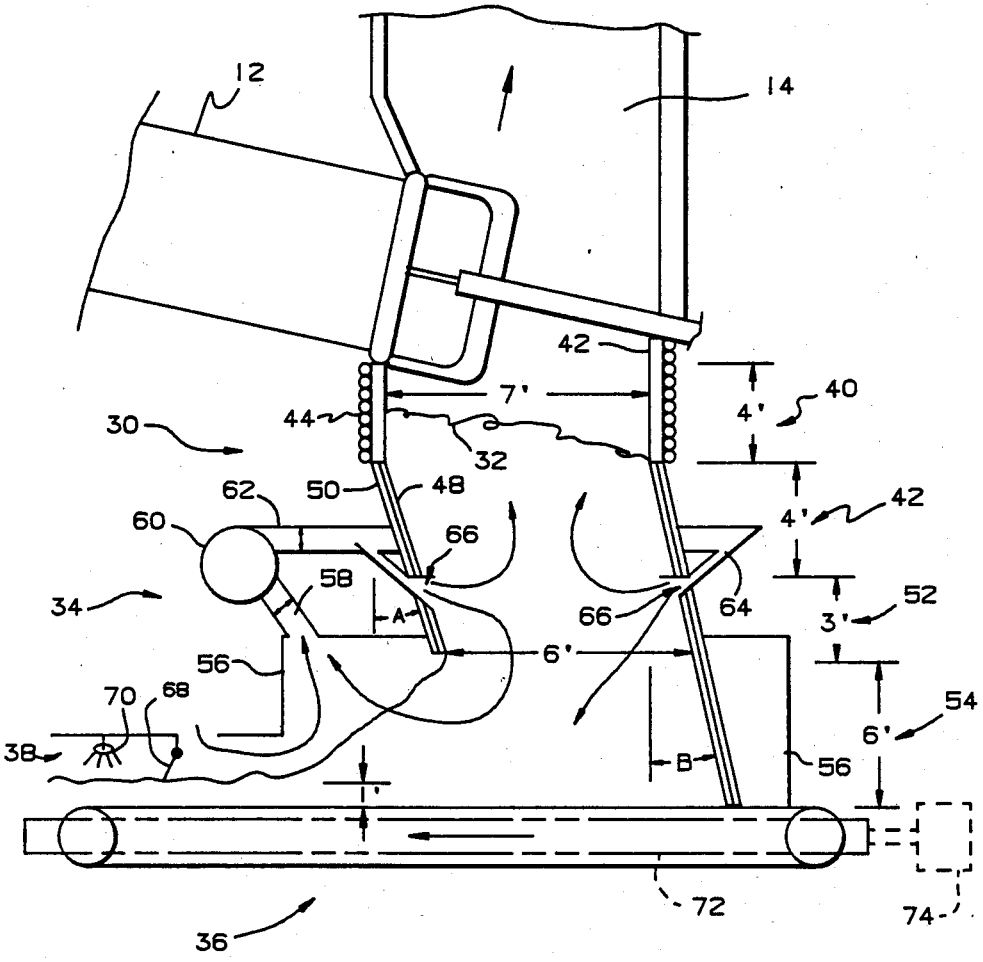
FIG. 2 illustrates a dry ash handling system in accordance with the present invention.

The ash, as it leaves the hopper 30, is carried by conveyor system 36. The conveyor system 36 in FIG. 2, for simplicity is depicted oriented to carry ash parallel to the combustor 12. In practice, the conveyor 36 would preferably be oriented perpendicular to the combustor 12 because a 13 foot wide conveyor continuous conveyor belt would have to be specially manufactured. Orientation in this manner would allow a readily available 7 foot wide conveyor to be used. The conveyor when oriented perpendicular to the combustor moves at a rate of approximately 0.32 feet per minute producing an average ash height of approximately one foot. This feed rate allows the ash to reside in the hopper 30 preferably for approximately 6.5 hours which allows complete combustion to occur in the approximately 2 hours that the ash takes to reach the level of the ports 66. Completion of combustion takes approximately 1 to 1½ hours and the feed rate must be slow enough to complete combustion before the ash reaches the ports 66. Because the ash is at approximately 150° when it reaches the top of the conveyor 36, a special high temperature conveyor is not required. A standard rubber belt conveyor, such as those used for conveying coal, is appropriate. A suitable conveyor system can be obtained from Stephen Adamson. The ash passes into the wetting chamber 38 through a flexible seal 68 before being sprayed by wetting nozzle 70 which can produce water or steam. A water spray of approximately 0.5 gallons per minute will produce ash with 5% moisture content.

An alternative to the conveyor system 36 is an oscillating steel plate which periodically moves parallel with the combustor 12 and then returns in the opposite direction, while travelling over cylindrical roller bearings. Moving plate systems of this type are commonly found in gravel machines associated with gravel pits and have an upper plate surface which is extremely hard. For a 13 foot long hopper 30 three steel plates 72 would be driven periodically by three hydraulic rams 74 each powered by a 2 horsepower electric motor. The movement in the direction of the arrow in FIG. 2 would allow ash to fall along the wall farthest from the combustor 12 and when the plate moved back, the ash would be compressed, keeping some ash outside the hopper 30. The hydraulic ram which is used to force waste from chute 10 into combustor 12 could be adapted for this purpose.

The many features and advantages of the invention are apparent from the detailed specification and thus, it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described, and accordingly, all suitable modifications and equivalents may be resorted to, falling within the scope of the invention.

We claim:

1. A dry ash handling system for a combustor, said system comprising:

ash burning means, coupled to the combustor, for continuing combustion of the ash by mixing the ash preventing air channel formation and pumping air into the ash; and ash conveying means for conveying burned ash away from said ash burning means.

2. A dry ash handling system for a combustor, comprising:

an ash hopper accepting ash from the combustor and providing a fixed ash height sufficient to allow substantially complete combustion of partially burned objects said hopper including mixing means for mixing the ash and preventing air channels; and ash conveying means, coupled to the bottom of said hopper, for conveying ash away from said hopper at a rate which maintains the fixed ash height.

3. A system as recited in claim 2, further comprising air injection means, coupled to said hopper substantially below a level of the fixed ash height, for injecting air upward through the ash completing combustion, cooling the ash and returning ash heat to the combustion process.

4. A system as recited in claim 3, wherein an amount of air travelling upward through the ash is at least equal to an ash flow rate.

5. A system as recited in claim 3, wherein said air injection means comprises:

air injection ports spaced at intervals around the exterior of said hopper and positioned substantially below the level; and an air pump cooled to said ports, forcing air upward through the ash via said ports and circulating air through the bottom of said hopper.

6. A dry ash handling system for a combustor producing a negative pressure, comprising:

an ash hopper accepting ash from the combustor and providing a fixed ash height sufficient to allow substantially complete combustion of partially burned objects;

ash conveying means, coupled to the bottom of said hopper, for conveying ash away from said hopper at a rate which maintains the fixed ash height;

air injection means, coupled to said hopper substantially below a level of the fixed ash height, for injecting air upward through the ash completing combustion, cooling the ash and returning ash heat to the combustion process, said air injection means comprising:

air injection ports spaced at intervals around the exterior of said hopper and positioned substantially below the level; and an air pump coupled to said ports and forcing air upward through the ash via said ports; and a shroud surrounding the bottom of said hopper, coupled to said pump and having an external air inlet for allowing air into said pump to replace the air travelling upward through the ash, said pump also pumping air downward through the ash.

7. A dry ash handling system for a combustor, comprising:

an ash hopper accepting ash from the combustor and providing a fixed ash height sufficient to allow substantially complete combustion of partially burned objects, said ash hopper including mixing means for mixing the ash and preventing air channels, and said mixing means comprising an inner wall of said hopper under the combustor angled away from the combustor at a first angle and an outer wall of said hopper angled away from the combustor at a second angle less than the first angle; and ash conveying means, coupled to the bottom of said hopper, for conveying ash away from said hopper at a rate which maintains the fixed ash height.

8. A system as recited in claim 7, wherein the first angle is approximately 20 degrees and the second angle is approximately 5 degrees.

9. A system as recited in claim 2, further comprising wetting means for increasing the moisture content of the ash after it leaves said hopper to approximately 5 percent.

10. A system as recited in claim 2, wherein said ash conveying means comprises a conveyor.

11. A system as recited in claim 2, wherein said ash conveying means is an oscillating plate.

12. A dry ash handling system for a rotary combustor producing a negative air pressure, said system comprising:

an ash hopper accepting ash from the combustor and providing a fixed ash height sufficient to allow substantially complete combustion of partially burned objects as the ash travels down said hopper, said hopper having an inner wall under the combustor angled away from the combustor at a first angle and an outer wall angled away from the combustor at a second angle less than the first angle;

air injection ports spaced at intervals around the exterior of said hopper and positioned substantially below the top of the ash in said hopper; and an air pump coupled to said ports and forcing air out through said ports and upward through the ash;

a shroud surrounding the bottom of said hopper, coupled to said pump and having an external air inlet for allowing air into said pump to replace the air travelling upward through the ash, said pump also pumping air downward through the ash; and ash conveying means, coupled to the bottom of said hopper, for conveying ash away from said hopper at a rate which maintains the fixed ash height.

13. A system as recited in claim 12, wherein an air flow rate upward through the ash is approximately equal to an ash flow rate down said hopper.

* * * * *